US007845254B2

(12) United States Patent
Lionel

(10) Patent No.: US 7,845,254 B2
(45) Date of Patent: Dec. 7, 2010

(54) FIREFIGHTER POCKET TOOL

(76) Inventor: Mike Lionel, 1757 Audrey Ct., Benicia, CA (US) 94510

( * ) Notice: Subject to any disclaimer, the term of this patent is extended or adjusted under 35 U.S.C. 154(b) by 77 days.

(21) Appl. No.: 12/072,051

(22) Filed: Feb. 23, 2008

(65) Prior Publication Data

US 2009/0211034 A1 Aug. 27, 2009

(51) Int. Cl.
*B25B 7/04* (2006.01)

(52) U.S. Cl. ..... 81/414; 81/125.1; 7/127; D8/56; D8/22

(58) Field of Classification Search ..... 81/405–414, 81/125.1; 7/125, 127, 138, 139, 161, 165; D8/22, 26, 55, 52, 81
See application file for complete search history.

(56) References Cited

U.S. PATENT DOCUMENTS 4,920,593 A 5/1990 Finn
4,995,128 A 2/1991 Montgomery et al.
5,014,379 A 5/1991 Hull et al.
5,251,353 A 10/1993 Lin
5,327,602 A 7/1994 Stenger
6,223,373 B1 * 5/2001 Yeh ..... 7/127
6,725,486 B2 * 4/2004 Oka ..... 7/127
6,899,001 B1 * 5/2005 Sanders et al. ..... 81/176.3

* cited by examiner

*Primary Examiner*—D. S. Meislin
(74) *Attorney, Agent, or Firm*—Rosenberg Klein & Lee

(57) ABSTRACT

A firefighter pocket tool combines the functional features of several traditional tools (slip groove pliers of the curved jaw type, 6 in 1 screwdriver, spanner wrench, gas shut off tool and a striking tool) onto a shared single structure. The tool comprises a pair of slip groove plier members each having a jaw portion, a joint portion and a handle portion, a pivotal bolt, nut and spring member. Upon the upper rear portion of the pliers' upper jaw's head there is formed a protrusion that forms a striking surface and a hook and claw which can be used as a spanner for rocker lug type and similar fire hose couplings. A gas shut off loop can be used as a guard for fingers when the tool is being used as a striking implement.

20 Claims, 11 Drawing Sheets

FIREFIGHTER POCKET TOOL

BACKGROUND OF THE INVENTION

1. Field of the Invention

The present invention relates generally to the field of multi-use tools. The invention relates more specifically to the field of firefighter pocket tools.

2. Background Art

The relevant prior art includes numerous issued U.S. patents which disclose unique tools configured to combine different tool functions into a unitary structure. By way of example, U.S. Pat. No. 4,920,593 to Finn also shows a tongue-in-groove type pliers with handles which terminate in screwdriver-shaped features. Another such combination tool is disclosed in U.S. Pat. No. 4,995,128 to Montgomery et al which shows pliers having handles which provide a crescent wrench and a screwdriver bit receptacle. Other such combination tools are shown in U.S. Pat. Nos. 5,014,379; 5,251,353 and 5,327,602.

Unfortunately, none of the known prior art combination tools is designed to be especially suited to the needs of firefighters. Thus for example, there is no disclosure of a dedicated gas shut-off feature, which is, of course, particularly important to a fireman. There is no disclosure of a wide opening spanner wrench that would be suitable for tightening or loosening standard diameter (i.e., 1½", 2½" and 3") water hose couplings used by fire departments. Moreover, none of the known prior art provides a plier-type arrangement which also provides the feature of a dedicated striking surface which may be of particular value to firemen who, in the course of an emergency, may need to carefully, without injuring themselves or others, gain access through a home or vehicle's window.

Therefore, there is still an ongoing need for a combination tool that is particularly configured for fire fighters and their unique requirements.

SUMMARY OF THE INVENTION

The objective of the firefighter pocket tool is to reduce the bulk and combined weight of carrying several tools, as well as making several tool functions available in one tool.

A firefighter pocket tool achieves its objectives by combining the functional features of several traditional tools (slip groove pliers of the curved jaw type, 6 in 1 screwdriver, spanner wrench, gas shut off tool and a striking tool) onto a shared single structure.

The structure of the firefighter pocket tool comprises a pair of slip groove plier members each having a jaw portion, a joint portion and a handle portion, a pivotal bolt, nut and spring member.

The upper jaw of the slip groove pliers is of the curved jaw type. Upon the "upper" rear portion of the pliers' "upper" jaw's head there is formed a protrusion that forms a striking surface and a hook and claw. The hook and claw is located so as to allow it to be used as a spanner for rocker lug type and similar fire hose couplings. As this same plier member crosses over the other plier member, it forms a plurality of arcuate adjustable channels with which the arcuate protuberance from the other plier member is engaged.

At the end of each handle is a hexagonal-shaped opening or receptacle. This opening or receptacle is used as a bit receptacle or as a nut driver. The holes are of a depth sufficient to hold two ended bits and incorporate a retention groove for the bits. The hexagonal shaped openings or receptacle are of two sizes: ¼ inch and 5/16 inch, respectively.

Protruding from the top or rear handle (just above the gripping area) is another protrusion. This protrusion is of a rectangular shape. In the middle of this protrusion is a loop in the shape slightly larger than standard natural gas shut off valves.

The lower jaw of the slip groove pliers is of a standard curved jaw configuration.

The two independently sized hexagonal open shafts that form the handles and nut-driver/bit holders, could be located on opposite legs of the pliers.

The spanner hook or claw could also be used to open containers or to operate smaller control valves (such as gas supply shut offs). The gas shut off loop can also be used as a guard for fingers when the tool is being used as a striking implement. The gas shut off loop can also be shaped to fit around and operate hydrant control valves.

The principal components of the firefighter pocket tool are:

The slip groove pliers' frame, is made of metal. The pliers' jaws are of the curved jaw type and incorporated in the slip groove pliers frame. A claw and hook is incorporated into the upper rear head portion of the slip groove pliers section of the tool. Incorporated into this claw or hook is a striking surface. The gas shut off tool is incorporated into the top handle of the slip groove pliers. At the ends of the slip groove pliers' handles are hexagonal openings. One is 5/16 inches in diameter and the other is ¼ inches in diameter. The bits are held in place by friction from spring loaded bearings in the bits. Bits have a conventional flat screwdriver end at one end and a phillips end on the other. Between the ends of the bits is located a hexagonal base in the lengthwise center on which is located a spring loaded ball. Each of these two-sided bits have a hexagonal midsection that is of such size to fit inside only one of the hexagonal openings (one is ¼ inch and the other is 5/16 inch in size).

To Use as a Gas Shut-Off Tool (This May Vary Depending on Service Equipment)

1) Adjust the tongue and groove of the pliers to the smallest setting.
2) With the pliers' jaws opened all the way. (handles should form an "L" shape.)
3) The gas shut off tool is positioned over the gas shut off head.
4) The opposite tool handle is then pushed or pulled away from the handle that incorporates the gas shut off.
5) Continue pushing or pulling the handle to cause the valve to rotate.
6) Stop rotating the gas shut off head when it is in the off position.

To Use as a Spanner Wrench:

1) Adjust the tongue and groove pliers to the largest setting.
2) Close the pliers' jaws.
3) Place the coupling against the back of the pliers' head.
4) Place the spanner hook around the coupling's rocker lug.
5) Rotate the tool in the proper direction.

To Use Screwdrivers or Nut Drivers:

1) Select the desired screwdriver bit or nut driver.
2) Adjust the tongue and groove pliers to the largest setting.
3) Fully open the pliers' jaws (handles all the way apart).
4) Open your hand fully.
5) Place the tool's jaw against the web of your thumb.
6) Wrap your thumb and fingers around the tool (gripping the tool like a handgun).
7) Adjust the orientation of the tool to have the desired drive pointing outward (other handle facing down) the grip will be similar to holding a handgun.

Optional Methods for Using the Screwdrivers or Nut Drivers:

To use the top screwdriver:

1) Adjust the tongue and groove pliers to the largest setting.
2) Fully close the pliers' jaws.
3) The top screwdriver now protrudes further than the bottom screwdriver.
4) You can open the pliers' jaws (open the handles to get more leverage.)

To Use the Bottom Screwdriver:

1) Adjust the tongue and groove pliers to the smallest setting.
2) Fully closer the pliers' jaws.
3) The bottom screwdriver will now protrude further than the top screwdriver.
4) You can open the pliers' jaws to get more leverage.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
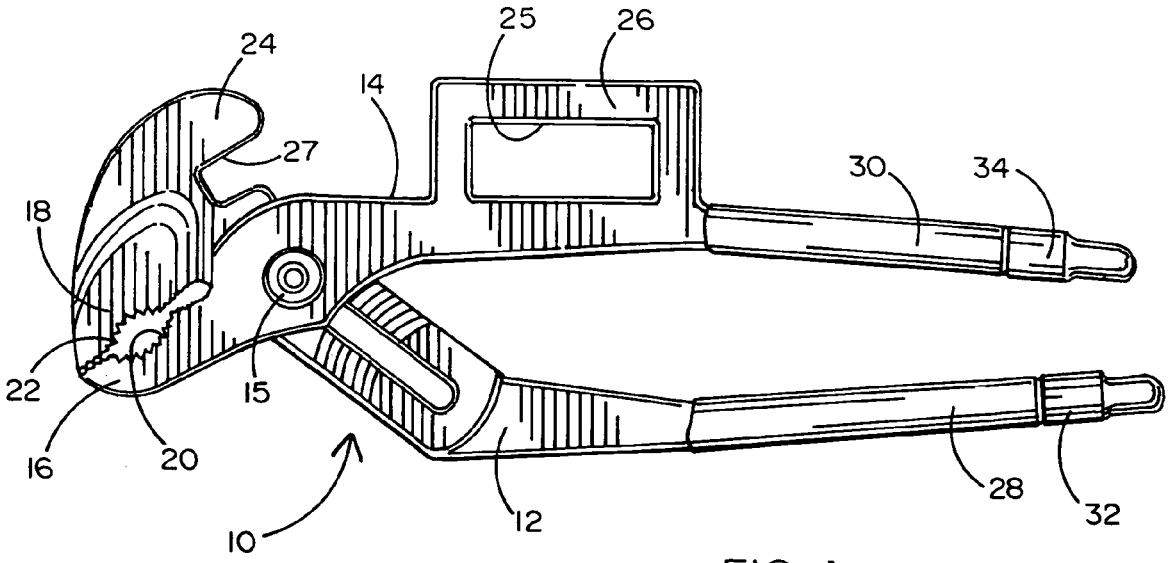
FIG. 1 is a left side view of a preferred embodiment of the invention.
Figure 2:
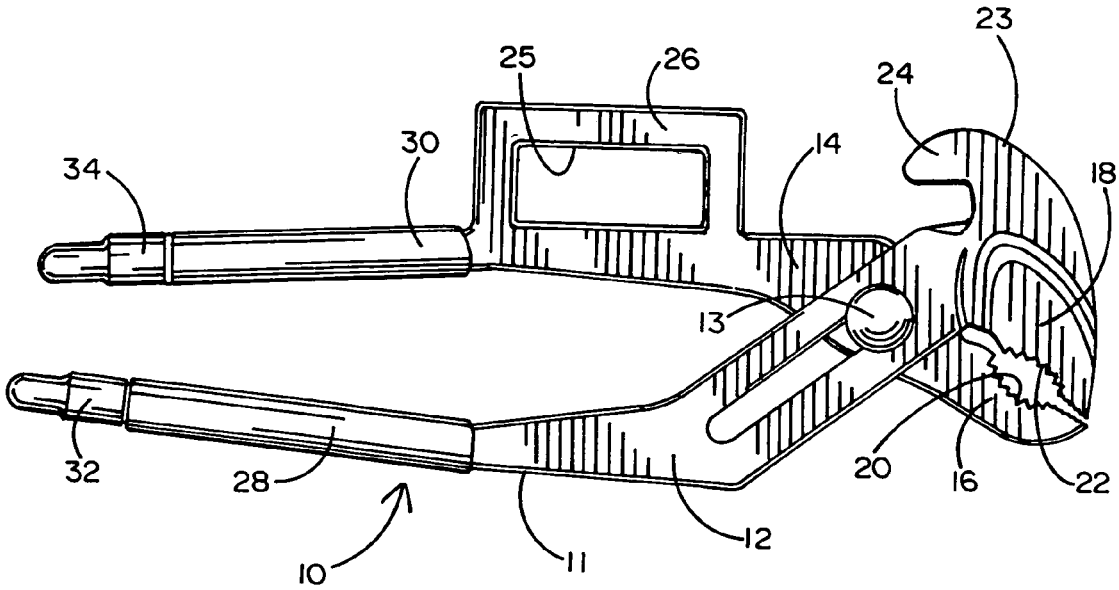
FIG. 2 is a right side view.

Referring now to the accompanying drawings and particularly to FIGS. 1 and 2, it will be seen that a firefighter's pocket tool 10 comprises a tongue-in-groove type plier 11 having mating members 12 and 14 held together for relative limited pivotal motion by a bolt 13 and nut 15. Members 12 and 14 terminate at one end respectively in mating jaws 16 and 18 which when closed form arcuate, serrated and substantially opposed gripping surfaces 20 and 22. Member 12 also comprises a striking surface 23 which terminates in a hook shaped extension 24 forming an arcuate recess 27. Members 12 and 14 terminate at a second end respectively in grasping handles 28 and 30.

Figure 3:
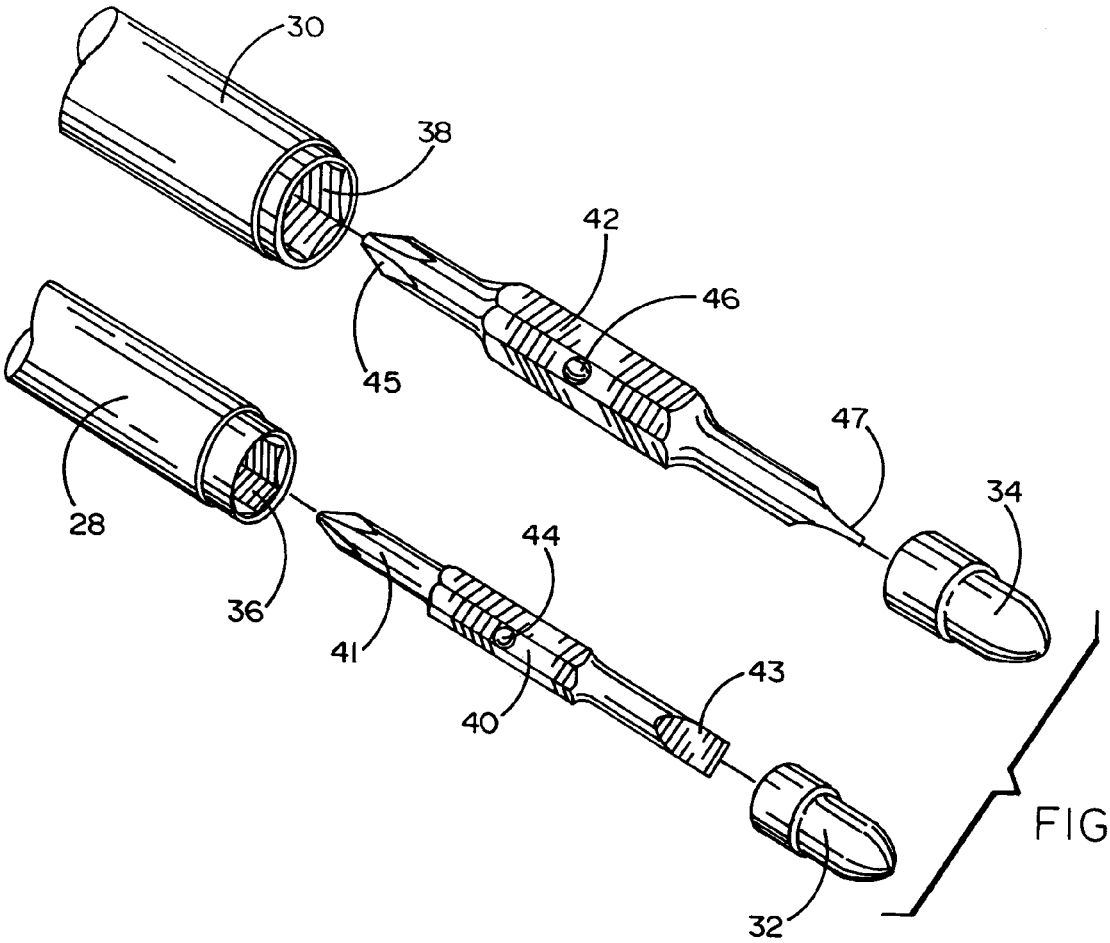
FIG. 3 is a view of the screwdriver handles thereof.
Figure 4:
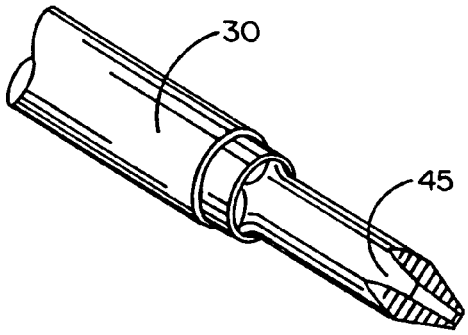
FIG. 4 is a view of a screwdriver handle after reversal of a bit thereof.
Figure 5:
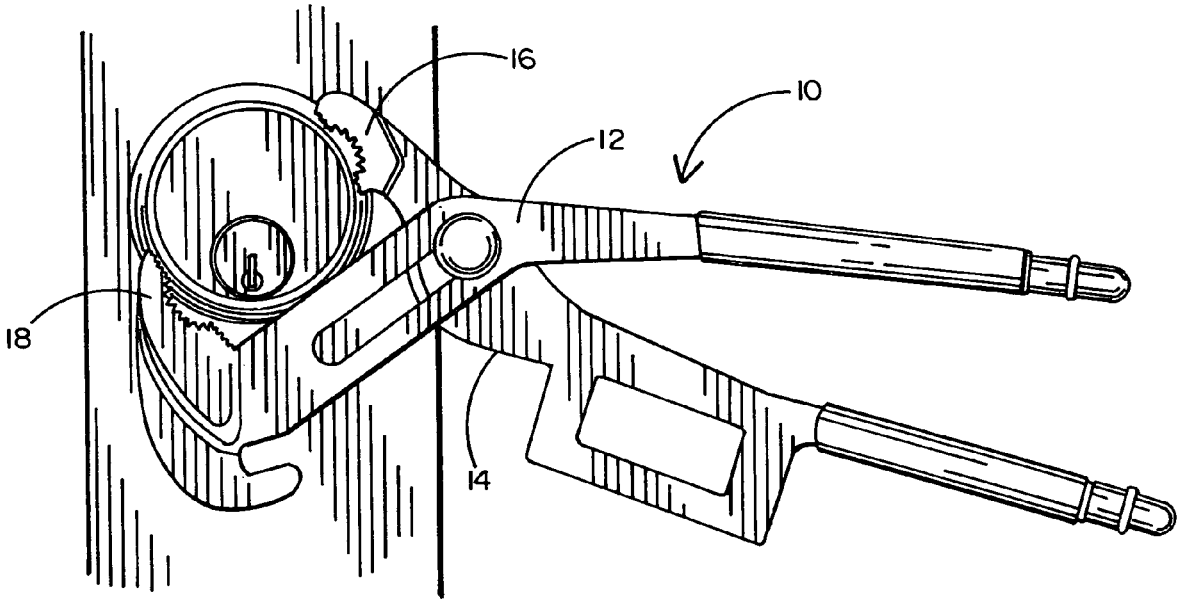
FIG. 5 illustrates use of the preferred embodiment for forcible entry of a locked door.

As seen best in FIGS. 3 and 4, handles 28 and 30 end with respectively open receptacles 36 and 38. These receptacles are of different diameters and have hexagonal cross-sections to retain respective screwdriver bits 40 and 42. Each such bit has opposed ends formed into phillips and flat head-type screwdrivers, respectively. Accordingly, bit 40 has phillips bit end 41 and flat head bit end 43. Bit 42 has phillips bit end 45 and flat head bit end 47. The extending bit ends may be enclosed in protective receptacles 32 and 34. Each bit has a recessible ball 44, 46 which holds the bits in place within the hexagonal cross-section inside handles 28 and 30 to releasably secure the bit to permit each to be removed and inverted to use the opposite end as a screwdriver. The handles may hold other tools having suitable shapes and dimensions such as hex head wrenches and the like.

Referring back to FIGS. 1 and 2, it will be seen that one of the two members 12 and 14 (member 14 in this example) provides integral gas valve closure member 26 which has a rectangularly-shaped inner loop opening 25.

Figure 6:
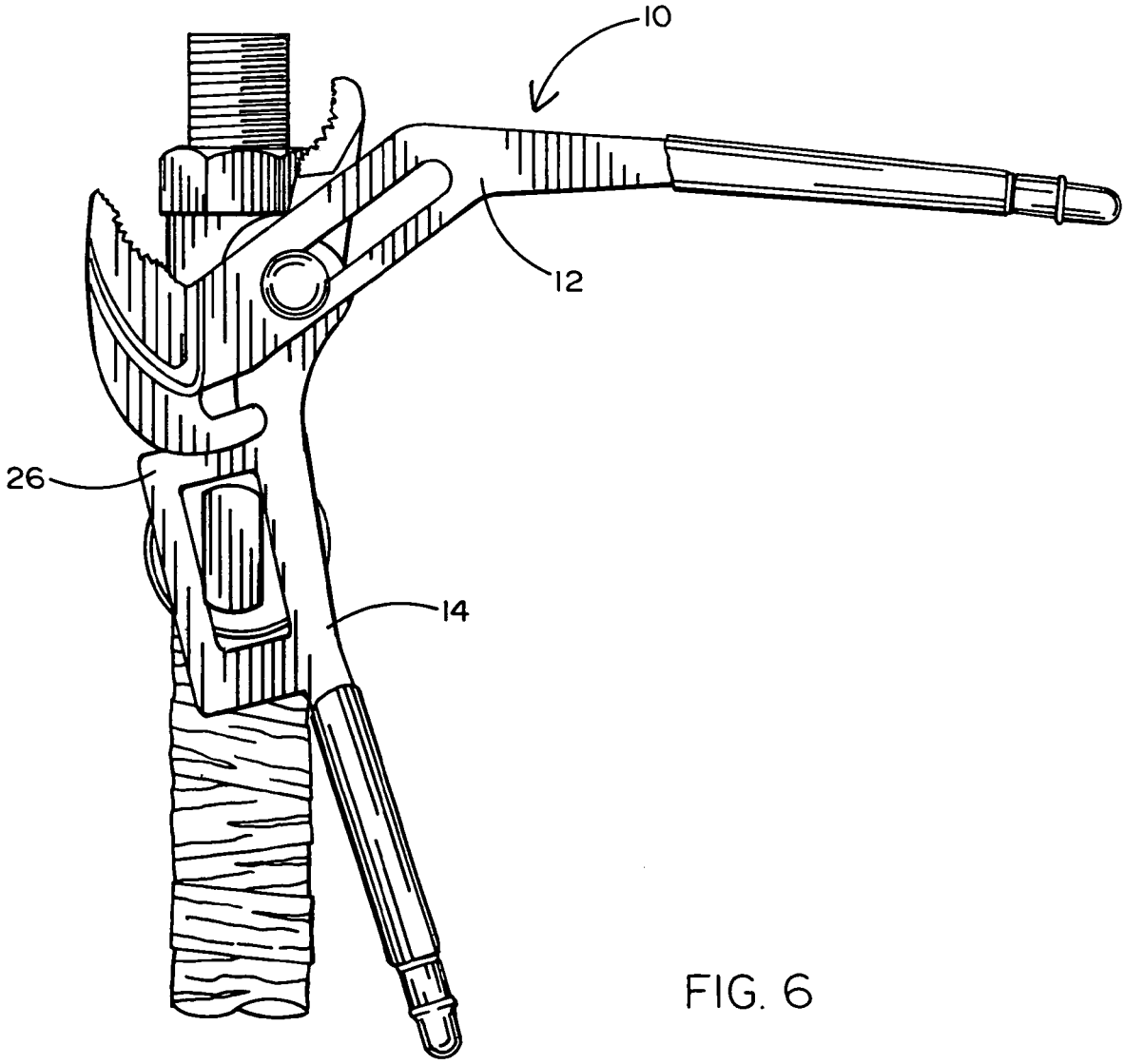
FIG. 6 illustrates use thereof for closing a gas valve shut-off.
Figure 7:
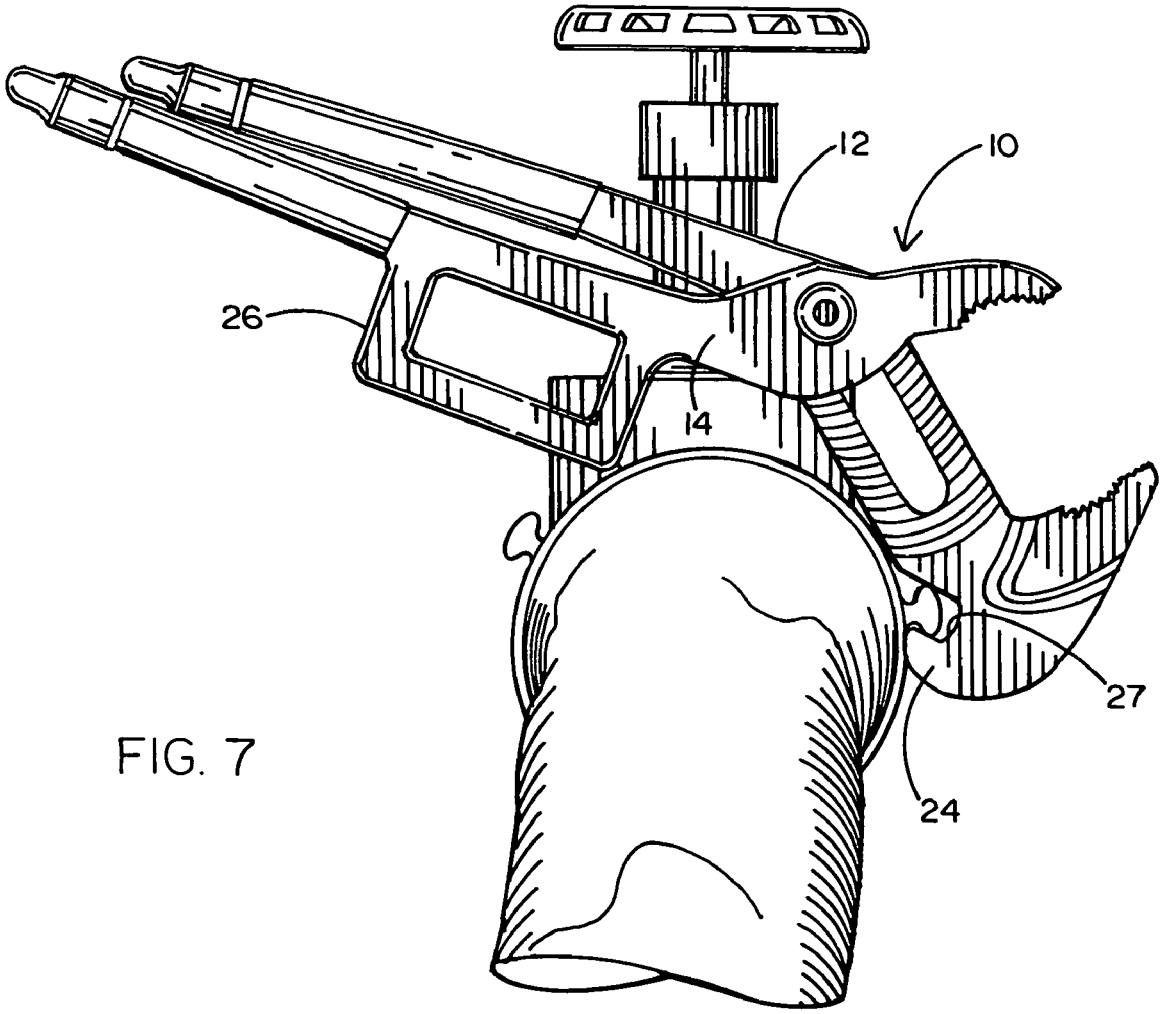
FIG. 7 illustrates use thereof as a spanner wrench.
Figure 8:
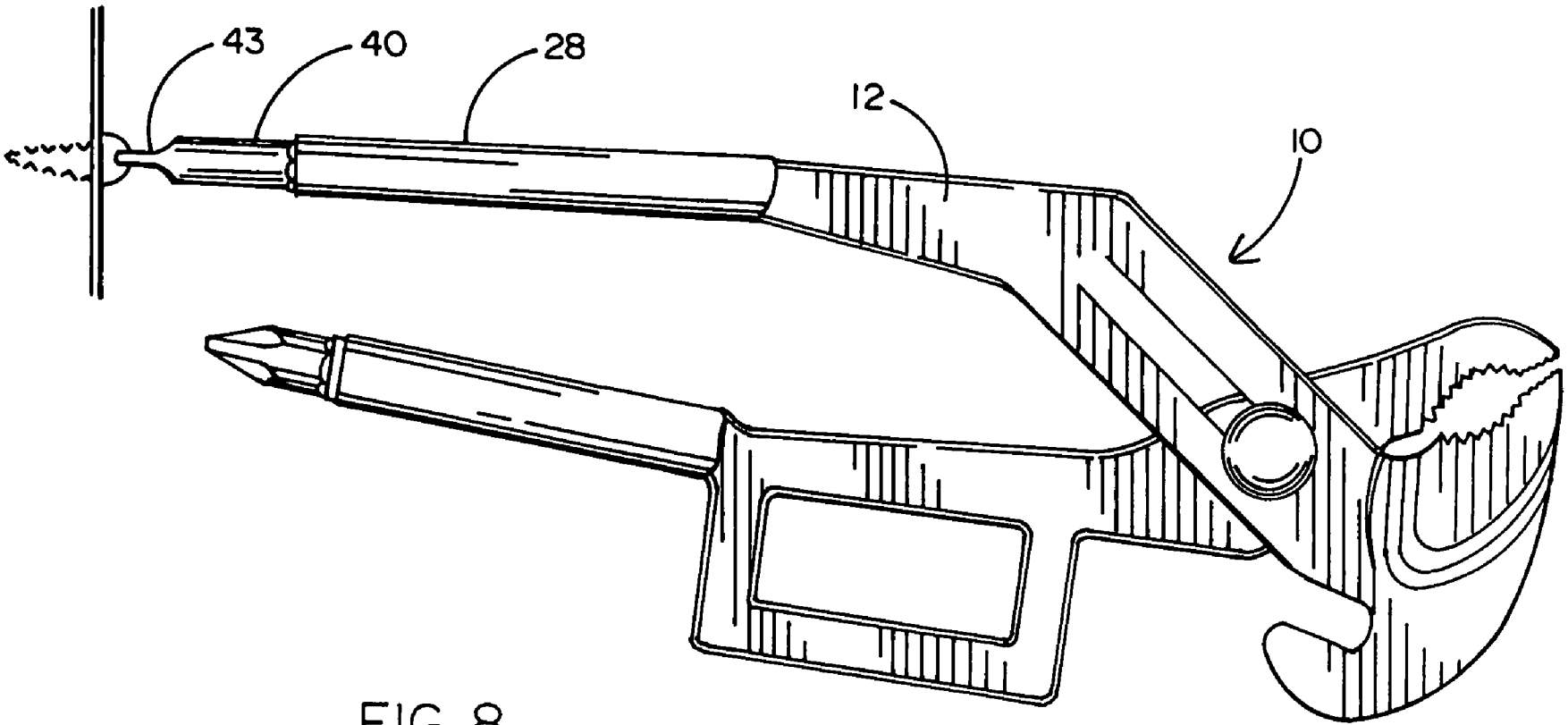
FIGS. 8 to 10 illustrate use thereof as a screwdriver.
Figure 9:
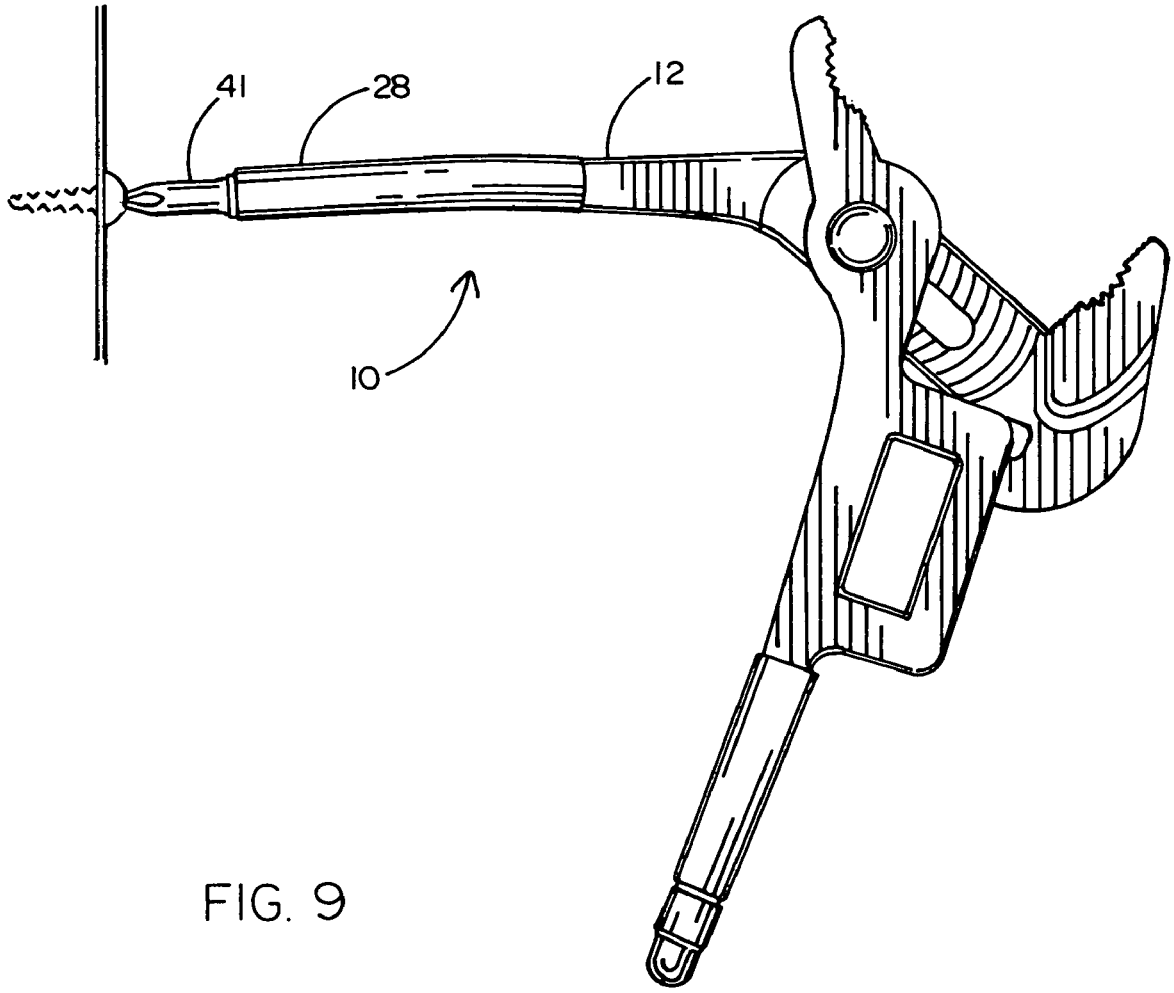
Figure 10:
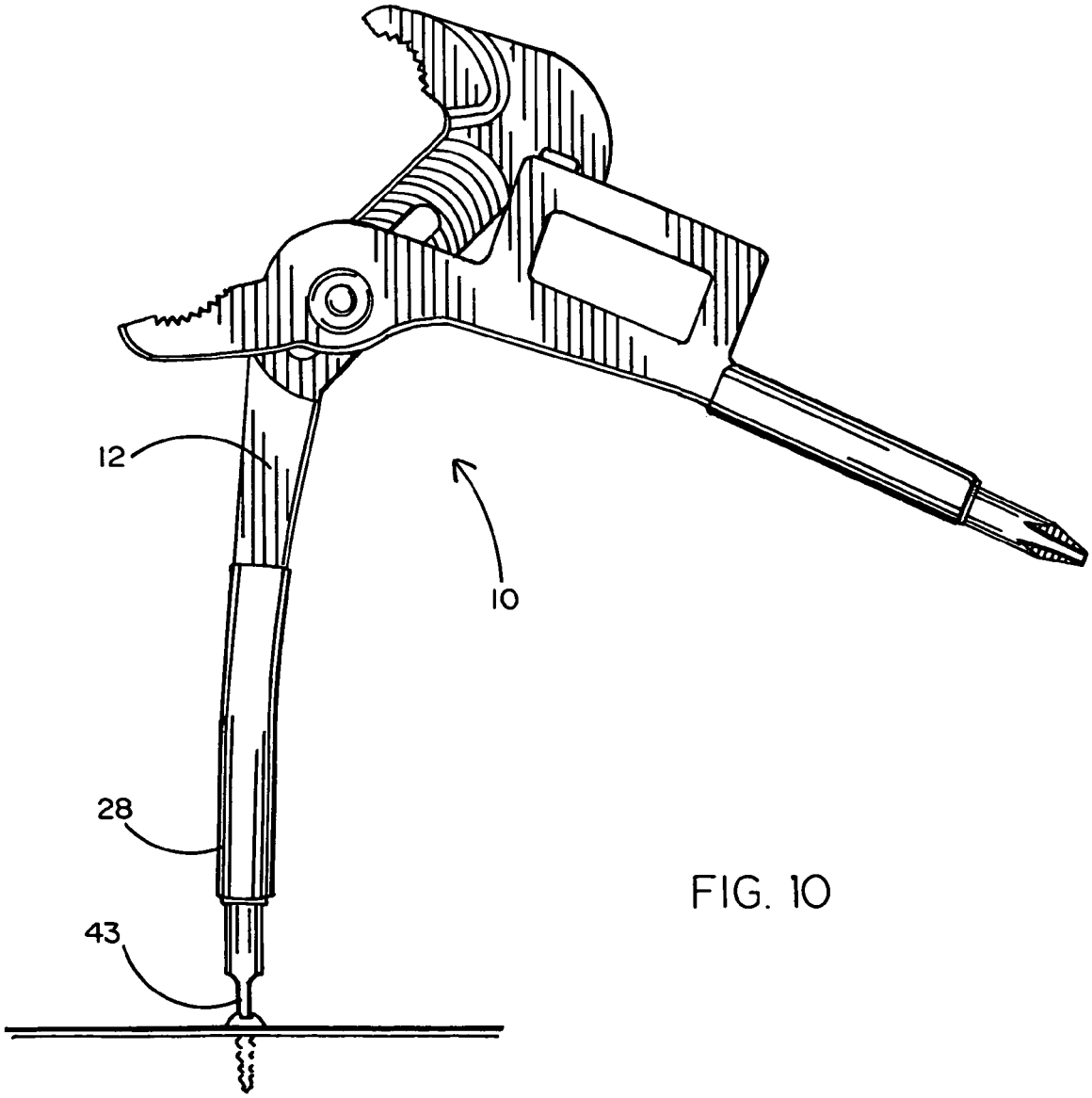
Figure 11:
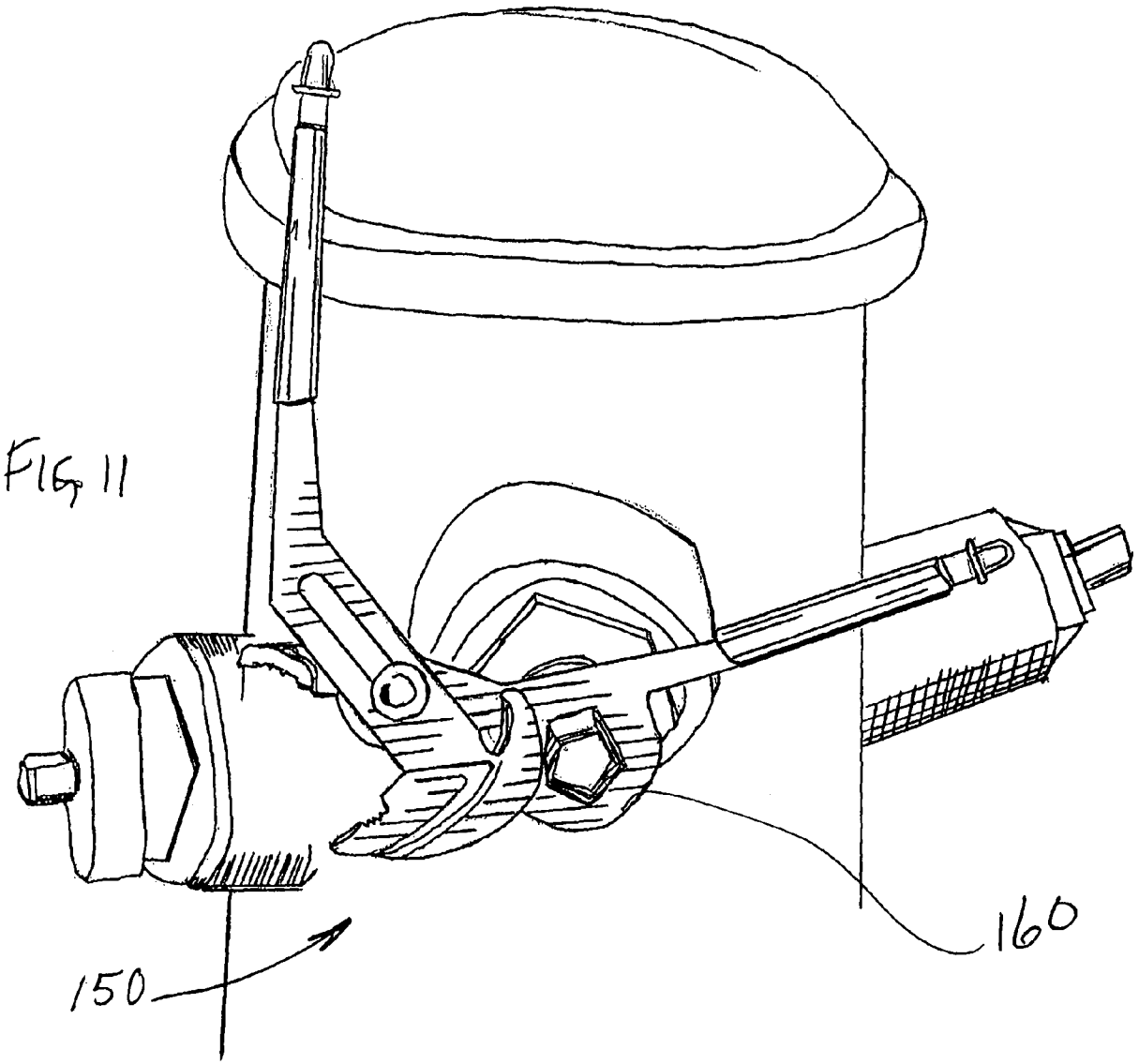
FIGS. 11 to 13 show an alternative embodiment with a different loop shape for operating hydrant valves.
Figure 12:
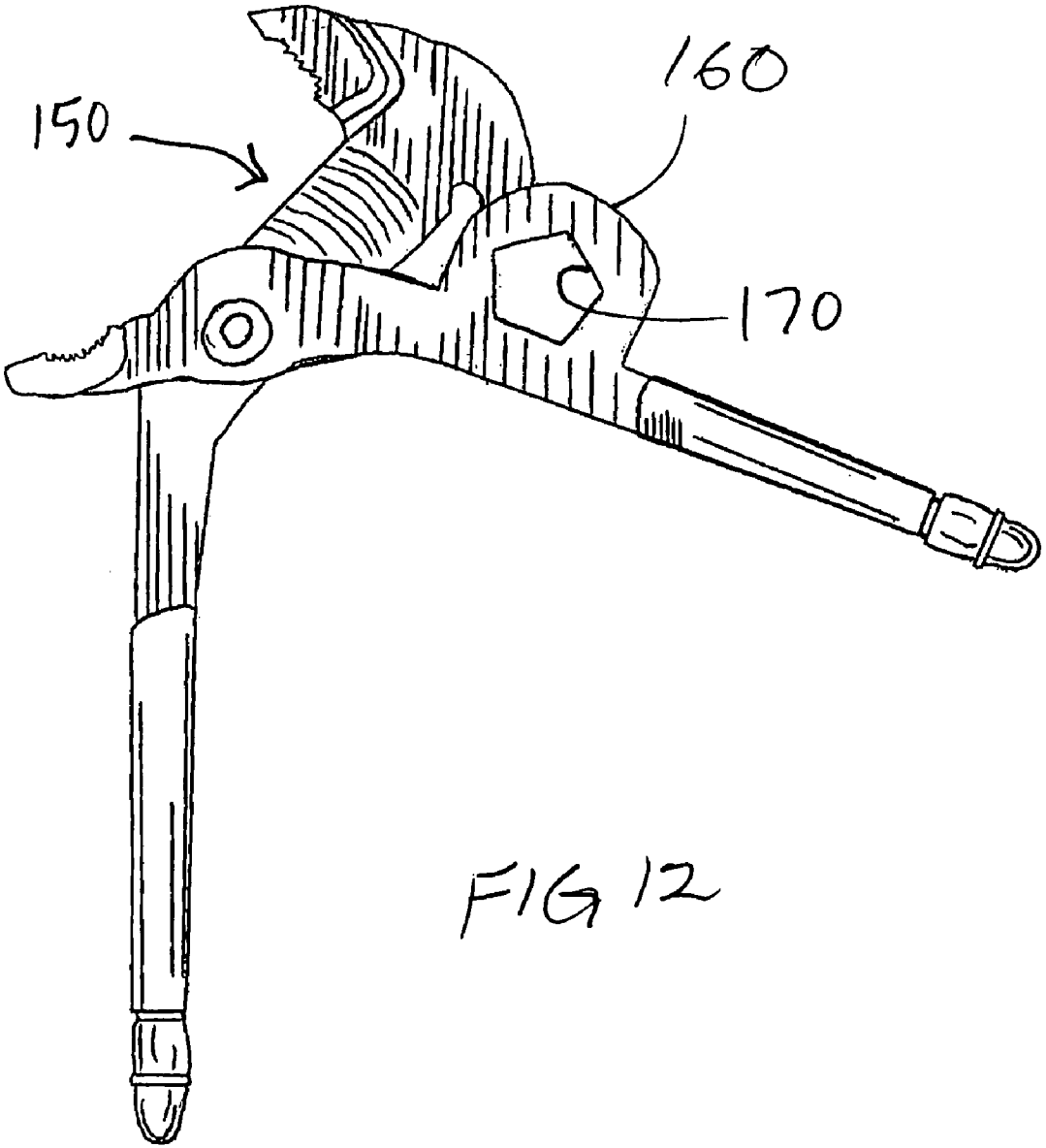
Figure 13:
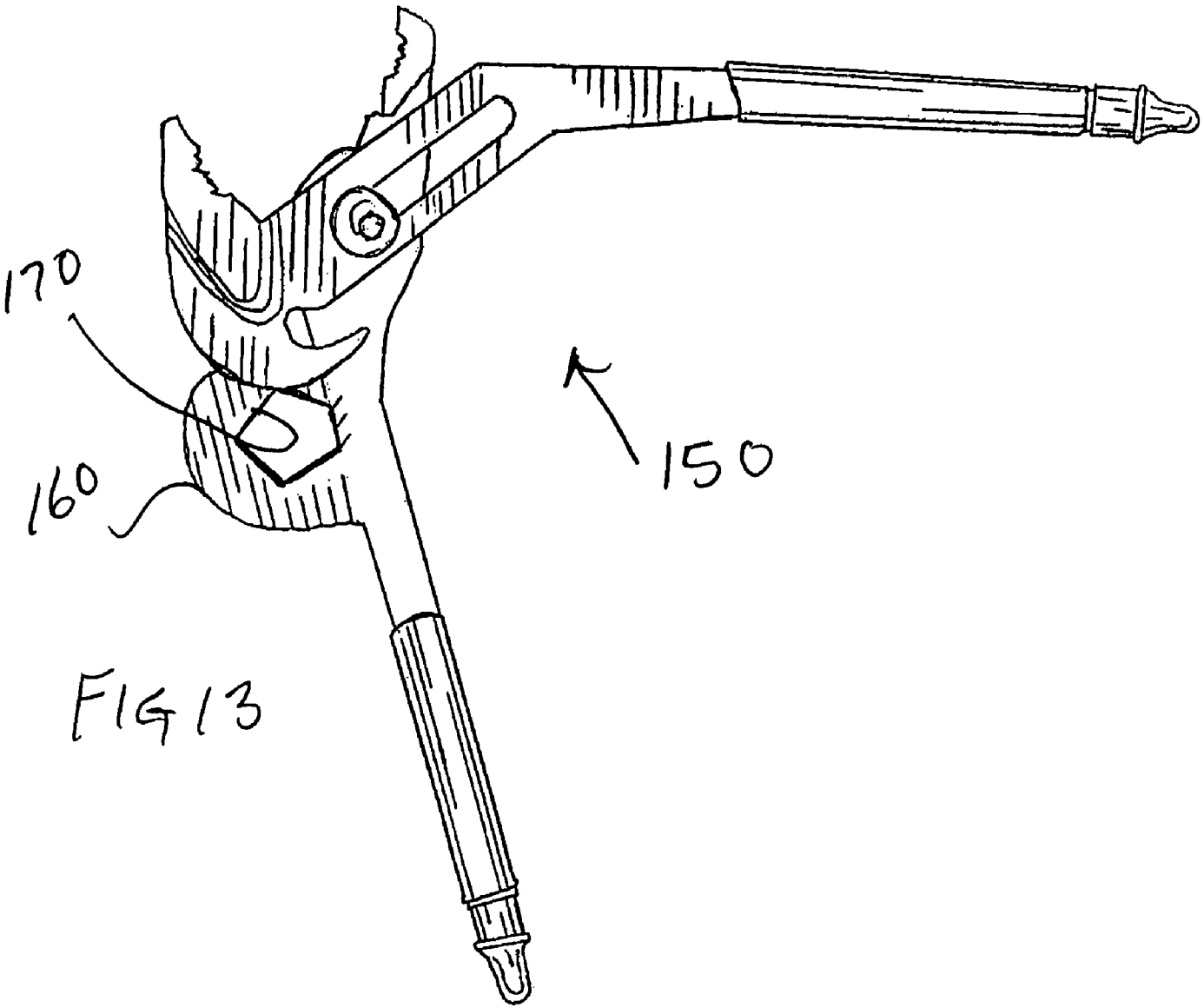

FIGS. 5 through 10 show the firefighter's pocket tool 10 being deployed in various configurations to be used for primarily typical purposes by a fireman. For example, in FIG. 5 tool 10 is shown being used to remove a deadbolt lock. In FIG. 6, tool 10 is shown being used to close a gas valve. In FIG. 7, tool 10 is being used to span a hose coupling. FIGS. 8 to 10 show various screwdriver deployments with the pliers' members in various configurations to permit different gripping positions. FIGS. 11 to 13 show an alternative embodiment 150 having a differently shaped loop 160 with a five-sided interior surface 170 for use on hydrant valves.

Thus it will now be understood that the present invention comprises a combination tool that is especially and uniquely configured for use by firemen. More particularly, the inventive tool hereof has features which are of particular importance for functions commonly required by firemen, but which otherwise would require a number of separate and bulky tools including for example, pliers, spanner wrench, valve wrench, hammer and a set of screwdrivers or other tool bits.

Those having skill in the art to which the present invention pertains, will now perceive various modifications and additions which may be made to the disclosed embodiment. Accordingly, it will be understood that the scope hereof is to be limited only by the appended claims and their equivalents.

I claim:

1. A multi-purpose tool apparatus providing a plurality of distinct functions including components to control different valves that may be employed by a firefighter at a burning structure; the tool comprising:

a pair of tongue-in-groove pliers having a pair of handle members pivotally interconnected with a coupling, said handle members respectively terminating by a pair of adjustable jaw members, at least a first of said handle members having an integral extension protruding from said jaw member thereof, said integral extension forming an engaging surface and defining a recess for use as a valve operating tool for tightening and loosening fire hose couplings and for turning small valves; and at least a second of said handle members comprising an integral loop-shaped extension of selected geometry for grasping a fluid control valve for opening and closing said valve, said integral loop-shaped extension protruding transversely from an intermediate portion of said second handle member and forming an outer engaging surface cooperating with said engaging surface of said integral extension to engage the fire hose coupling.

2. The tool apparatus recited in claim 1 wherein said selected geometry is rectangular and said fluid control valve is a gas shut-off valve.

3. The tool apparatus recited in claim 1 wherein said integral extension further comprises an arcuate striking surface configured for forceful impact with a breakable surface.

4. The tool apparatus recited in claim 1, said pivoting handle members having tool bit receptacles at respective ends opposite said jaw members thereof; and at least one tool bit releasably received in a selected one of said receptacles.

5. The tool apparatus recited in claim 1, wherein said integral loop-shaped extension is positioned relative to said integral extension and recess in angularly adjustable manner.

6. The tool apparatus recited in claim 1, wherein said handle members are pivotally displaceable between fully open and closed positions, said handle members bearing against one another in said fully open position to form a substantially L-shaped configuration.

7. The tool apparatus recited in claim 1, wherein said integral extension of said first handle member defines a hook-shaped extension about said recess for cooperative use with said integral loop-shaped extension of said second handle member as a spanner wrench for opening and closing fire hoses and as a valve operating tool.

8. The tool apparatus recited in claim 7, wherein said hook-shaped extension further comprises an arcuate striking surface configured for forceful impact with a breakable surface.

9. A multi-purpose tool apparatus for firefighters, the tool providing a plurality of distinct functions including multiple valve control operations that may be employed by a firefighter at a burning structure; the tool comprising:

a pair of tongue-in-groove pliers having a pair of handle members pivotally interconnected with a coupling, said handle members respectively terminating by a pair of opposed adjustable jaw members, wherein at least one of said handle members comprises an integral loop-shaped extension of selected geometry for grasping a fluid control valve for opening and closing said valve, said integral loop-shaped extension protruding transversely from an intermediate portion of the one handle member and forming an outer engaging surface; and wherein at least the other of said handle members includes an integral extension protruding from said jaw member thereof to form an engaging surface and define a recess for use as a valve operating tool, said engaging surface of said integral extension cooperating with said outer engaging surface of said integral loop-shaped extension to engage a fire hose coupling.

10. The tool apparatus recited in claim 9 wherein said selected geometry is rectangular or pentagon and said fluid control valve is a gas shut-off valve or fluid valve.

11. The tool apparatus recited in claim 9, said pivoting handle members having screwdriver bit receptacles at respective ends opposite said jaw members thereof; and at least one screwdriver bit releasably received in a selected one of said receptacles.

12. The tool apparatus recited in claim 9, wherein said integral extension of said first handle member defines a hook-shaped extension about said recess for cooperative use with said integral loop-shaped extension of said second handle member as a spanner wrench for opening and closing fire hoses and as a valve operating tool.

13. The tool apparatus recited in claim 12, wherein said hook-shaped extension further comprises an arcuate striking surface configured for forceful impact with a breakable surface.

14. The tool apparatus recited in claim 9, wherein said handle members are pivotally displaceable between fully open and closed positions, said handle members bearing against one another in said fully open position to form a substantially L-shaped configuration.

15. A multi-purpose firefighting tool apparatus comprising:

a pair of longitudinally extended plier members pivotally interconnected with a coupling, each of the plier members defining handle and jaw portions at opposed sides of the coupling;

at least a first of said plier members having an integral extension protruding from said jaw portion thereof, said integral extension forming a bulbous striking surface and an engaging surface, said integral extension defining a recess for receiving portions of fire hose and valve couplings; and, at least a second of said plier members comprising an integral loop-shaped extension defining a polygonal opening for retentively engaging a fluid control valve, said integral loop-shaped extension protruding transversely from an intermediate portion of said second plier member handle portion and forming an outer engaging surface cooperating with said engaging surface of said integral extension to engage the fire hose coupling.

16. The tool apparatus recited in claim 15, wherein said selected geometry is rectangular and said fluid control valve is a gas shut-off valve.

17. The tool apparatus recited in claim 15, wherein said pivoting handle members include: tool bit receptacles at respective ends opposite said jaw members thereof; and at least one tool bit releasably received in a selected one of said receptacles.

18. The tool apparatus recited in claim 15, wherein said integral loop-shaped extension is positioned relative to said integral extension and recess in angularly adjustable manner.

19. The tool apparatus recited in claim 15, wherein said handle members are pivotally displaceable between fully open and closed positions, said handle members bearing against one another in said fully open position to form a substantially L-shaped configuration.

20. The tool apparatus recited in claim 15, wherein said integral extension of said first handle member defines a hook-shaped extension about said recess for cooperative use with said integral loop-shaped extension of said second handle member as a spanner wrench for opening and closing fire hoses and as a valve operating tool.

* * * * *